US009985348B2

(12) United States Patent
Lee et al.

(10) Patent No.: US 9,985,348 B2
(45) Date of Patent: May 29, 2018

(54) CONTROLLED RECEPTION PATTERN ANTENNA

(71) Applicant: ELECTRONICS AND TELECOMMUNICATIONS RESEARCH INSTITUTE, Daejeon (KR)

(72) Inventors: Dae Heon Lee, Daejeon (KR); Woong Hee Kim, Changwon-si (KR); Dong Hoon Shin, Daejeon (KR); Jinchun Wang, Daejeon (KR); Inho Hwang, Daejeon (KR); Sangwoo Park, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 32 days.

(21) Appl. No.: 14/833,054

(22) Filed: Aug. 22, 2015

(65) Prior Publication Data

US 2016/0211583 A1 Jul. 21, 2016

(30) Foreign Application Priority Data

Jan. 20, 2015 (KR) ..... 10-2015-0009137

(51) Int. Cl.
*H01Q 13/10* (2006.01)
*H01Q 1/48* (2006.01)
*H01Q 9/04* (2006.01)

(52) U.S. Cl.
CPC ..... *H01Q 1/48* (2013.01); *H01Q 9/0407* (2013.01)

(58) Field of Classification Search
CPC ..... H01Q 13/10; H01Q 21/064; H01Q 3/22; H01Q 3/443
(Continued)

(56) References Cited

U.S. PATENT DOCUMENTS 7,450,082 B1 * 11/2008 Lopez ..... H01Q 7/00 343/844
2007/0057846 A1 * 3/2007 Song ..... H01Q 9/30 343/700 MS
(Continued)

FOREIGN PATENT DOCUMENTS

JP 09-232864 A 9/1997
JP 09232864 A * 9/1997 ..... H01Q 1/32
(Continued)

OTHER PUBLICATIONS

Heeyoung Kim et al., "Design of a Dual-Band GPS Array Antenna," The Journal of Korean Institute of Electromagnetic Engineering and Science, 2013.

*Primary Examiner* — Dameon E Levi
*Assistant Examiner* — Collin Dawkins
(74) *Attorney, Agent, or Firm* — LRK Patent Law Firm

(57) ABSTRACT

Disclosed herein is a controlled reception pattern antenna that prevents the degradation of anti-jamming performance in a compact array antenna by increasing the antenna gain at a low elevation angle. The proposed antenna includes a radiator for receiving a satellite signal, a ground platform in which the radiator is arranged, and a radiating slot formed in the ground platform. By simply forming a radiating slot in the ground platform, antenna gain may be increased at a low elevation angle. Therefore, it is possible to maintain anti-jamming performance and to reduce the size of the array antenna.

3 Claims, 8 Drawing Sheets

(58) Field of Classification Search
USPC ..... 343/770, 768, 867, 700 MS
See application file for complete search history.

(56) References Cited

U.S. PATENT DOCUMENTS

| | | | | |
|---|---|---|---|---|
| 2011/0193758 | A1* | 8/2011 | Liu | H01Q 13/106 343/767 |
| 2012/0009884 | A1* | 1/2012 | Rao | H01Q 1/243 455/73 |
| 2014/0247194 | A1* | 9/2014 | Durnan | H01Q 7/00 343/867 |

FOREIGN PATENT DOCUMENTS

| | | | |
|---|---|---|---|
| JP | 2010-200292 | A | 9/2010 |
| KR | 10-2010-0045200 | A | 5/2010 |
| KR | 10-2011-0118385 | A | 5/2012 |

* cited by examiner

CONTROLLED RECEPTION PATTERN ANTENNA

CROSS REFERENCE TO RELATED APPLICATION(S)

This application claims the benefit of Korean Patent Application No. 10-2015-0009137, filed Jan. 20, 2015, which is hereby incorporated by reference in its entirety into this application.

BACKGROUND OF THE INVENTION

1. Technical Field

The present invention generally relates to a controlled reception pattern antenna, and more particularly, to a Global Navigation Satellite System (GNSS)-controlled reception pattern antenna for removing interference signals.

2. Description of the Related Art

The Global Navigation Satellite System (GNSS), represented by the Global Positioning System (GPS), is a satellite navigation system that precisely measures a user's position and provides visual information by receiving information about a satellite position, time, and error correction factors, from a satellite.

Currently, the GNSS is variously used in land, sea, and air systems in various military and civilian fields.

The GNSS is a communication system of which a reception structure for satellite signals has been disclosed, and has a weak reception signal because the satellite signal is transmitted from a long distance, more than about 20,000 km.

Therefore, the GNSS is very weakly resistant to unintentional electromagnetic interference such as multipath interference, or to intentional electromagnetic jamming.

In particular, if the GNSS system is jammed while providing accurate visual information to national infrastructures such as mobile communications, finances, Digital Multimedia Broadcasting (DMB), and smart grids, serious problems may result.

As a representative conventional art for responding to jamming or interference, which may be serious threats to the GNSS, there is a method that removes jamming signals using an array antenna. This is a technique whereby signals to a desired direction are increased and unwanted jamming signals are reduced by spatially disposing multiple antennas and applying a complex weighting to the respective outputs. Specifically, Korean Patent Application Publication No. 2011-0118385 discloses a method in which the gain in the direction of an antenna beam is controlled by adjusting the phase adjustment values of one or more phase controllers, connected to each antenna element.

However, such techniques consider only array antenna operating scenarios and digital signal processing methods, and do not provide a method for designing the array antenna itself.

Also, to install an array antenna in a mobile vehicle (automobiles, trains, vessels, aircrafts, etc.), it is critical to reduce the size of the array antenna. However, when the size of the array antenna decreases, the distance between elements of the antenna is decreased. As a result, mutual coupling increases, and distortion is generated in the antenna pattern by finite ground effects. Eventually, there would be a problem in that the antenna gain decreases at a low elevation angle.

Alternatively, as a related conventional art, U.S. Patent Publication No. 2014-0247194 discloses increasing an antenna bandwidth by disposing a plurality of low-loss Teflon substrates between a radiating element and a ground plane.

Also, as another related conventional art, a dual-bandwidth GPS patch antenna having a hybrid feeding structure was disclosed in the journal of the Korea Electromagnetic Engineering Society (Vol. 24, No. 7, pp. 678-685, "Design of a dual-band GPS array antenna", July, 2013, Heeyoung Kim, et al.).

SUMMARY OF THE INVENTION

Accordingly, the present invention has been made keeping in mind the above problems occurring in the conventional art, and an object of the present invention is to provide a controlled reception pattern antenna that prevents the degradation of anti-jamming performance in a compact array antenna by increasing the antenna gain at a low elevation angle.

Another object of the present invention is to provide a controlled reception pattern antenna that uses low-cost ceramic patch and has the advantage of having a simple structure.

To accomplish the above object, a controlled reception pattern antenna according to the preferred embodiment of the present invention includes a radiator for receiving a satellite signal; a ground platform in which the radiator is arranged; and a radiating slot formed in the ground platform.

The radiator and the radiating slot may include N (N is a positive integer) number of radiators and N number of radiating slots, respectively; the N number of radiators may be formed to be separated from each other in the ground platform; and the N number of radiating slots may be formed to be separated from each other in the ground platform.

Each of the N number of radiating slots may be formed between adjacent radiators.

Each of the N number of radiating slots may have a length corresponding to ¼ of a center wavelength of an operating band.

The radiator may be a ceramic patch-type radiator.

The ground platform may have a circular form.

According to the present invention configured as described above, antenna gain increases at a low elevation angle by simply forming a radiating slot in the ground platform. Therefore, it is possible to maintain anti-jamming performance and to reduce the size of the array antenna.

In other words, according to the present invention, by forming a radiating slot in the ground platform of an array antenna, the antenna gain increases at a low elevation angle, whereby GNSS satellite signals may be received in the whole upper hemisphere. Also, the antenna has a simple structure and a reduced size, and may be implemented using a low-cost commercial ceramic patch antenna.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
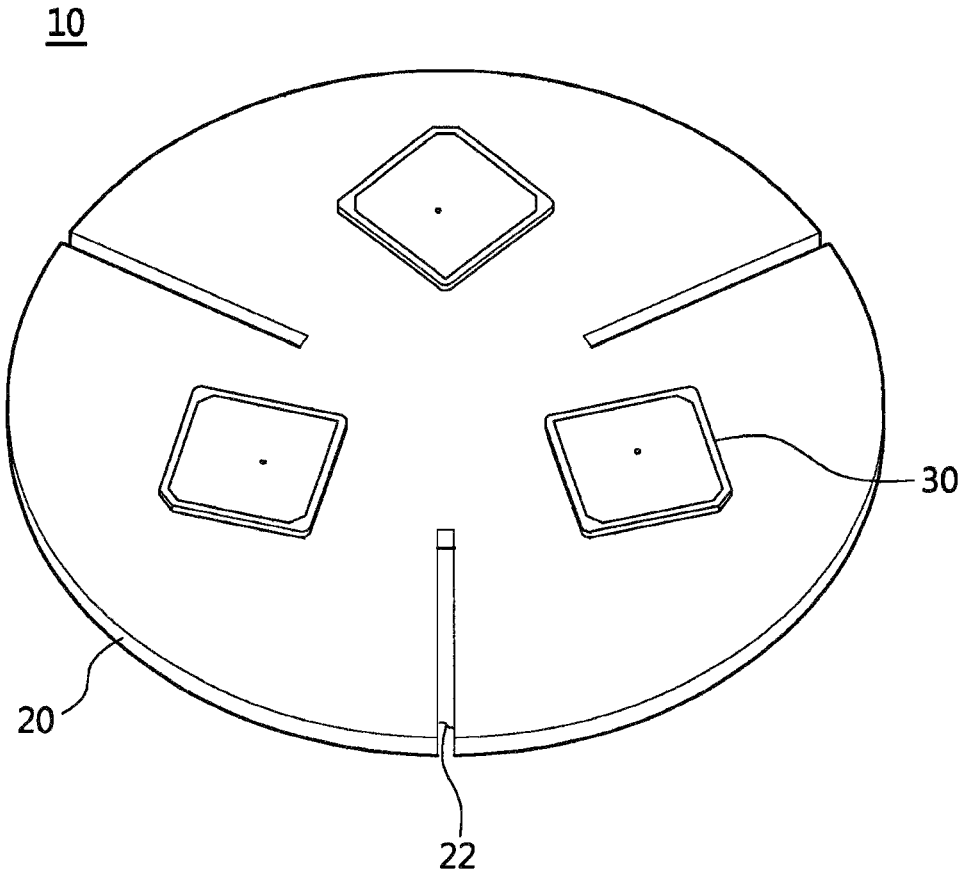
FIG. 1 is a perspective view of a controlled reception pattern antenna according to an embodiment of the present invention.

The present invention may be variously changed, and may have various embodiments, and specific embodiments will be described in detail below with reference to the attached drawings.

However, it should be understood that those embodiments are not intended to limit the present invention to specific disclosure forms and they include all changes, equivalents or modifications included in the spirit and scope of the present invention.

The terms used in the present specification are merely used to describe specific embodiments, and are not intended to limit the present invention. A singular expression includes a plural expression unless a description to the contrary is specifically pointed out in context. In the present specification, it should be understood that terms such as "include" or "have" are merely intended to indicate that features, numbers, steps, operations, components, parts, or combinations thereof are present, and are not intended to exclude the possibility that one or more other features, numbers, steps, operations, components, parts, or combinations thereof will be present or added.

Unless differently defined, all terms used here including technical or scientific terms have the same meanings as the terms generally understood by those skilled in the art to which the present invention pertains. The terms identical to those defined in generally used dictionaries should be interpreted as having meanings identical to contextual meanings of the related art, and are not interpreted as having ideal or excessively formal meanings unless they are definitely defined in the present specification.

Embodiments of the present invention will be described in detail with reference to the accompanying drawings. In the following description of the present invention, the same reference numerals are used to designate the same or similar elements throughout the drawings, and repeated descriptions of the same components will be omitted.

Figure 2:
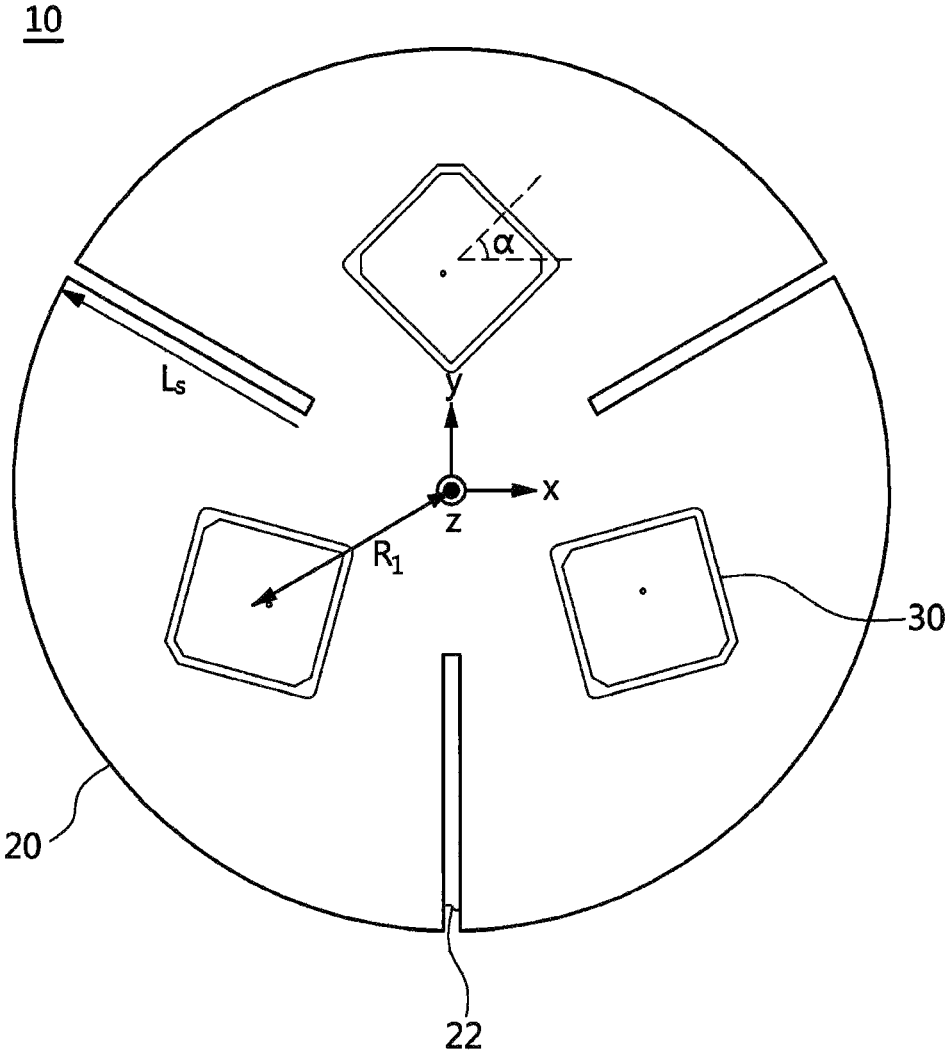
FIG. 2 is a plan of a controlled reception pattern antenna according to an embodiment of the present invention.

FIG. 1 is a perspective view of a controlled reception pattern antenna (CRPA) according to an embodiment of the present invention, and FIG. 2 is a plan of a controlled reception pattern antenna according to an embodiment of the present invention.

A controlled reception pattern antenna 10 according to an embodiment of the present invention includes a ground platform 20 and a radiator 30.

One or more radiator slots 22 are formed in the ground platform 20. The ground platform 20 may have, for example, a circular form.

The radiator 30 is a ceramic patch-type radiator, and may receive a satellite signal (that is, a GNSS signal). The radiator 30 is arranged in the ground platform 20. The radiator 30 may be implemented using a commercial low-cost GPS antenna.

FIGS. 1 and 2 show a structure in which three radiators 30 are arranged in the ground platform 20. More specifically, the three radiating slots 22 are formed to be separated from each other in the ground platform 20, and three radiators 30 are also formed to be separated from each other in the ground platform 20. Namely, each of the radiators 30 is disposed between two adjacent radiating slots 22. In other words, each of the radiating slots 22 is formed between two adjacent radiators 30. N (N is a positive integer) number of radiators 30 and N number of radiating slots 22 may be formed in the ground platform 20.

Accordingly, the controlled reception pattern antenna 10 exemplified in FIG. 1 and FIG. 2 has a structure in which a 3-element array antenna is arranged in the ground platform 20.

On the other hand, as shown in FIG. 2, the position ($R_1$) and the direction ($\alpha$) of a radiator 30 are optimized to raise the pattern consistency of each of the antenna elements. In particular, in the present invention, a radiating slot 22 is disposed between antenna elements to increase the antenna gain at a low elevation angle. In this case, the length ($L_s$) of the radiating slot 22 may be determined to operate as the parasitic element of the adjacent antenna element ($L_s=\lambda/4$). Here, $\lambda$ is the center wavelength of an operating band. Namely, the radiating slot 22 has a length corresponding to ¼ of the center wavelength of the operating band. A slot having a length of $\lambda/4$ resonates at a corresponding frequency and operates as a radiating slot 22 (serves as an antenna).

Consequently, the radiating slot 22, operating as the parasitic element of the radiator 30, increases the antenna gain at a low elevation angle, whereby it may minimize antenna pattern distortion.

Figure 3:
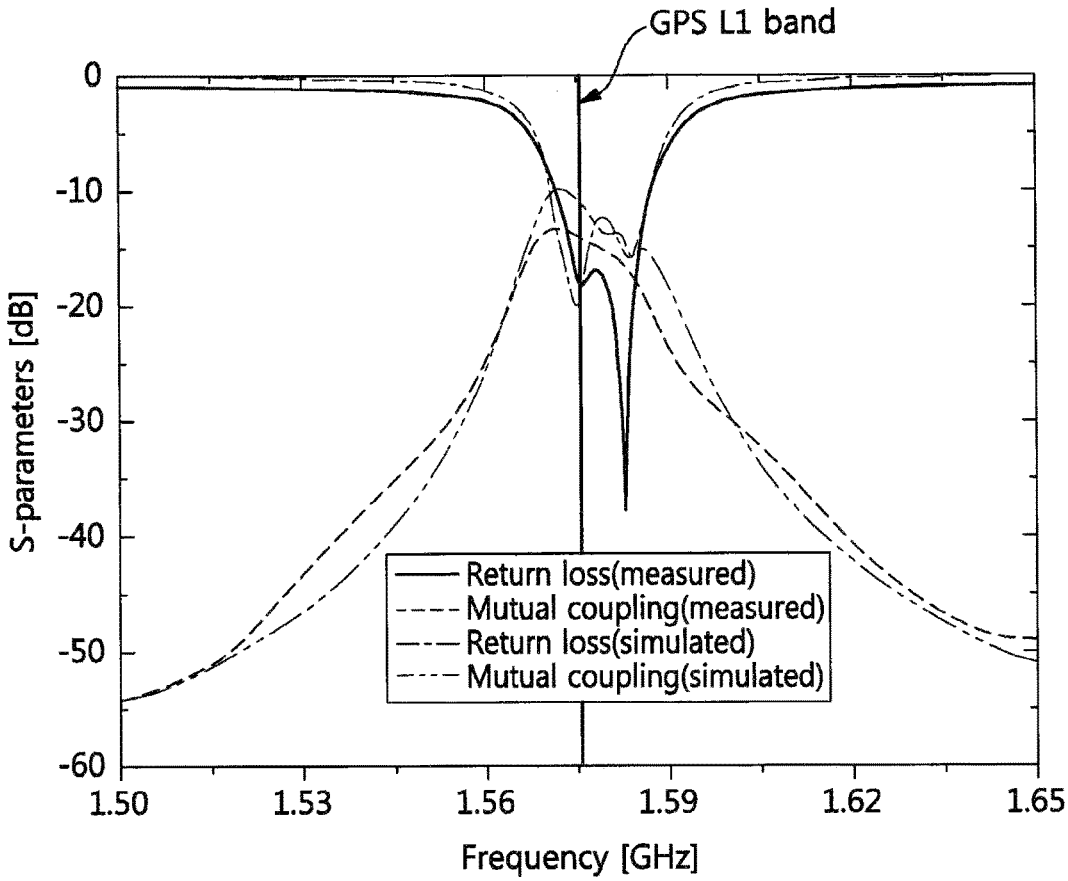
FIG. 3 is a graph illustrating the return loss and the mutual coupling of a controlled reception pattern antenna according to an embodiment of the present invention.

FIG. 3 is a graph illustrating the return loss and the mutual coupling of a controlled reception pattern antenna according to an embodiment of the present invention.

As illustrated in FIG. 3, in a GPS L1 band (For example, at 1575.42 MHz), the return loss is equal to or less than −17.8 dB, and the mutual coupling (isolation) is equal to or less than −13.7 dB. Therefore, the basic performance of an array antenna is satisfied.

Figure 4:
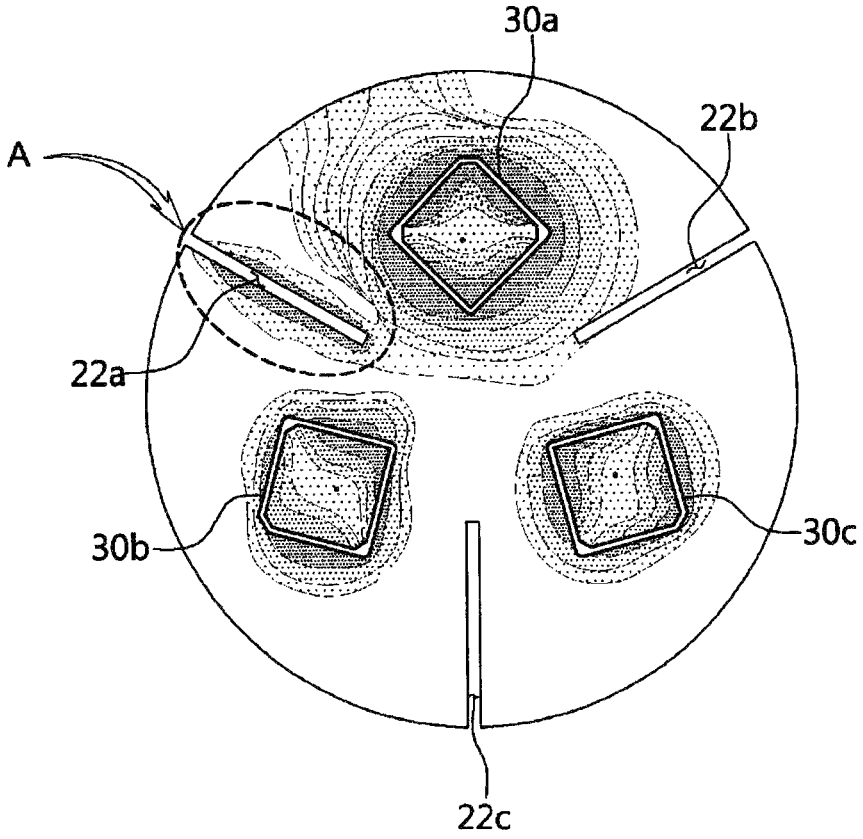
FIG. 4 is a distribution chart illustrating surface current when power is fed to the first antenna element for a controlled reception pattern antenna according to an embodiment of the present invention.
Figure 5:
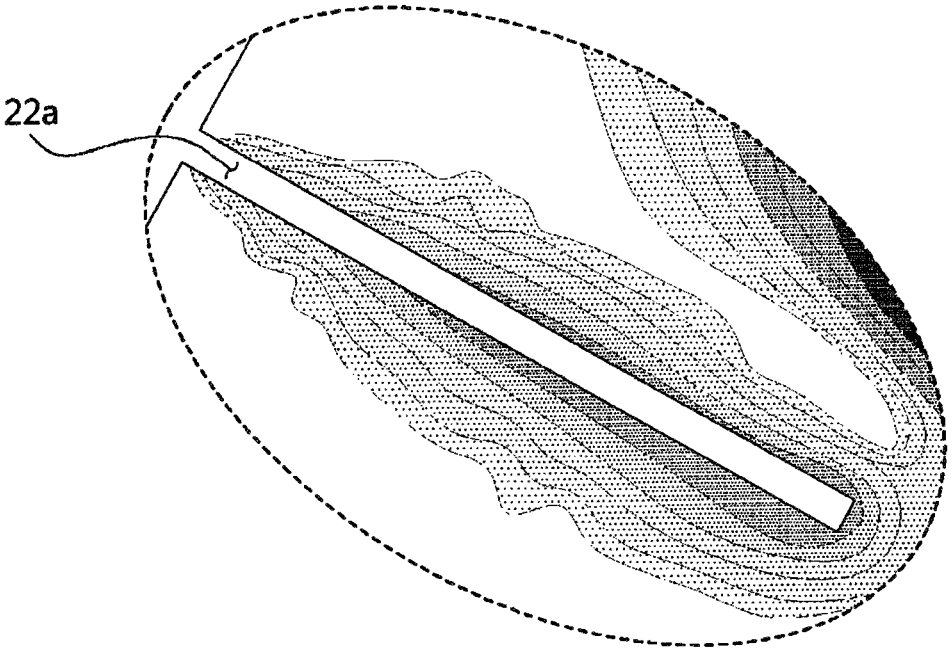
FIG. 5 is an enlarged view of A of FIG. 4.

FIG. 4 is a distribution chart illustrating the surface current when power is fed to the first antenna element of a controlled reception pattern antenna according to an embodiment of the present invention, and FIG. 5 is an enlarged view of A of FIG. 4.

Specifically, FIGS. 4 and 5 show the surface current distribution of an array antenna in the GPS L1 band when power is fed to the first antenna element 30*a* (the second antenna element 30*b* and the third antenna element 30*c* are matched to 50Ω).

As shown in FIGS. 4 and 5, the radiating slots 22*a* and 22*b* adjacent to the first antenna element 30*a* resonate, and the surface current increases compared to another radiating slot 22*c*. Therefore, the radiating slots 22*a* and 22*b* operate as the parasitic element of the first antenna element 30*a*, and serve as an antenna.

Figure 6:
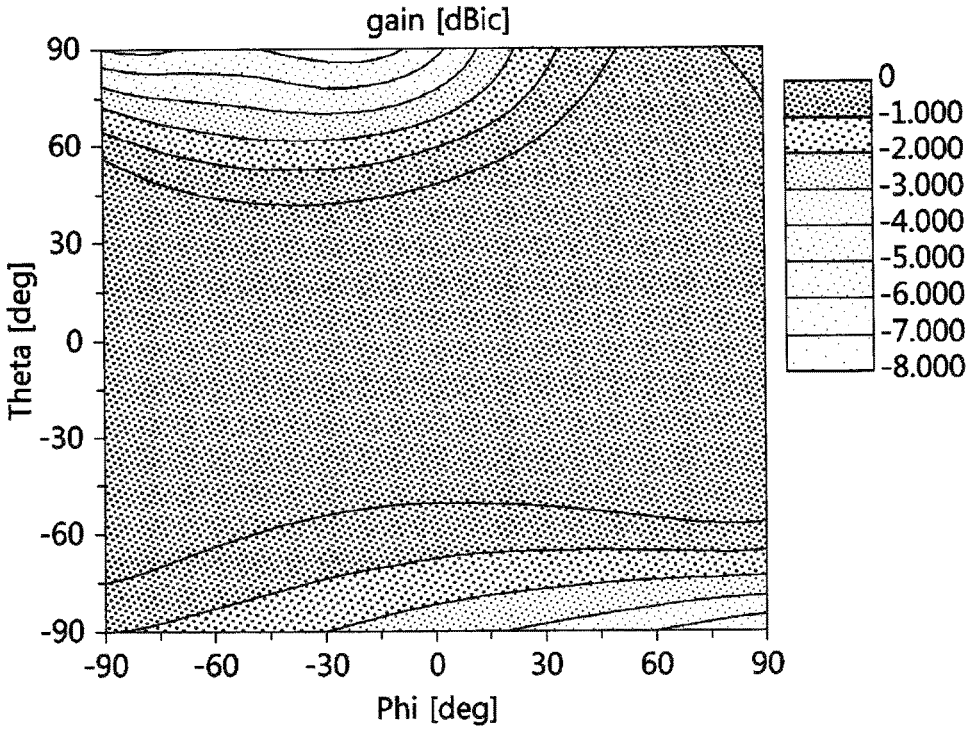
FIG. 6 is a graph illustrating the upper hemisphere right handed circular polarization antenna gain of a controlled reception pattern antenna having a radiating slot in an embodiment of the present invention.
Figure 7:
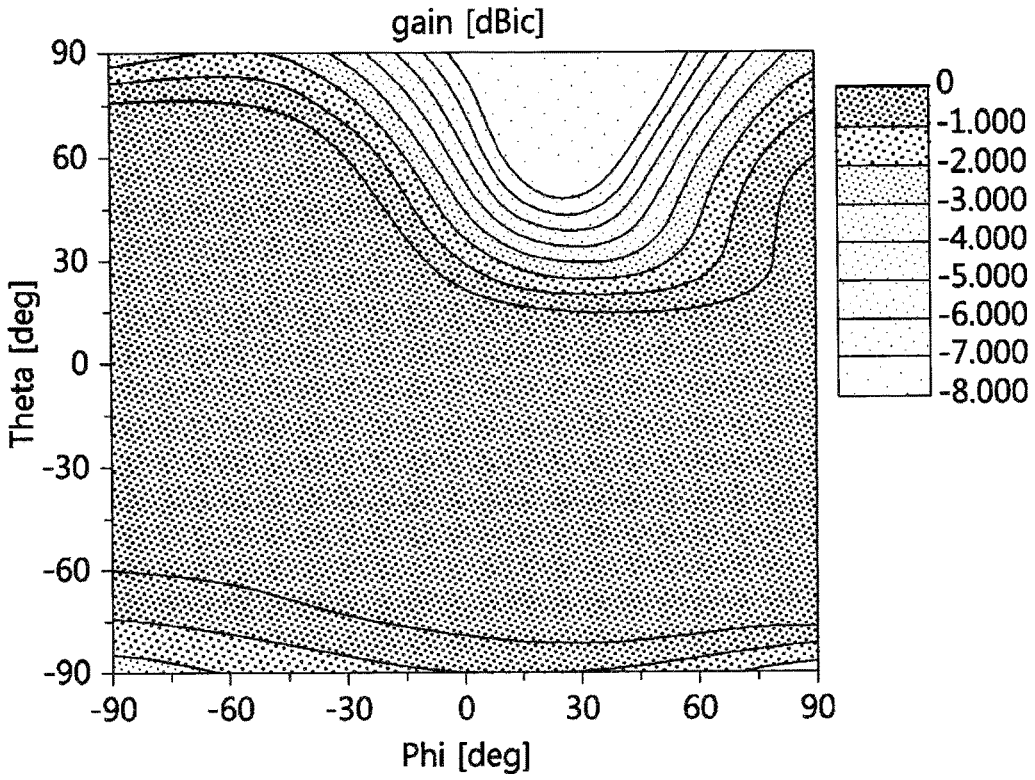
FIG. 7 is a graph illustrating the upper hemisphere right-hand circular polarization antenna gain of a controlled reception pattern antenna without a radiating slot in an embodiment of the present invention.

FIG. 6 is a graph illustrating the upper hemisphere right-handed circular polarization antenna gain of a controlled reception pattern antenna having a radiating slot, and FIG. 7 is a graph illustrating the upper hemisphere right-handed circular polarization antenna gain of a controlled reception pattern antenna without a radiating slot.

To analyze the effect of a radiating slot 22, a comparison is made of the upper hemisphere right-handed circular polarization (RHCP) antenna gain of a CRPA in the case including a radiating slot (FIG. 6) and the case without a radiating slot (FIG. 7).

First, as illustrated in FIG. 6, a CRPA including a radiating slot 22 shows a gain equal to or greater than −5.3 dBic at low elevation angles, including the horizontal plane (Theta=90°). Meanwhile, as illustrated in FIG. 7, a CRPA without a radiating slot 22 shows about −7.8 dBic of a gain at low elevation angles.

Therefore, a gain increase greater than 2.5 dB is achieved at low elevation angles, including a horizontal plane, simply by adding a radiating slot 22.

Figure 8:
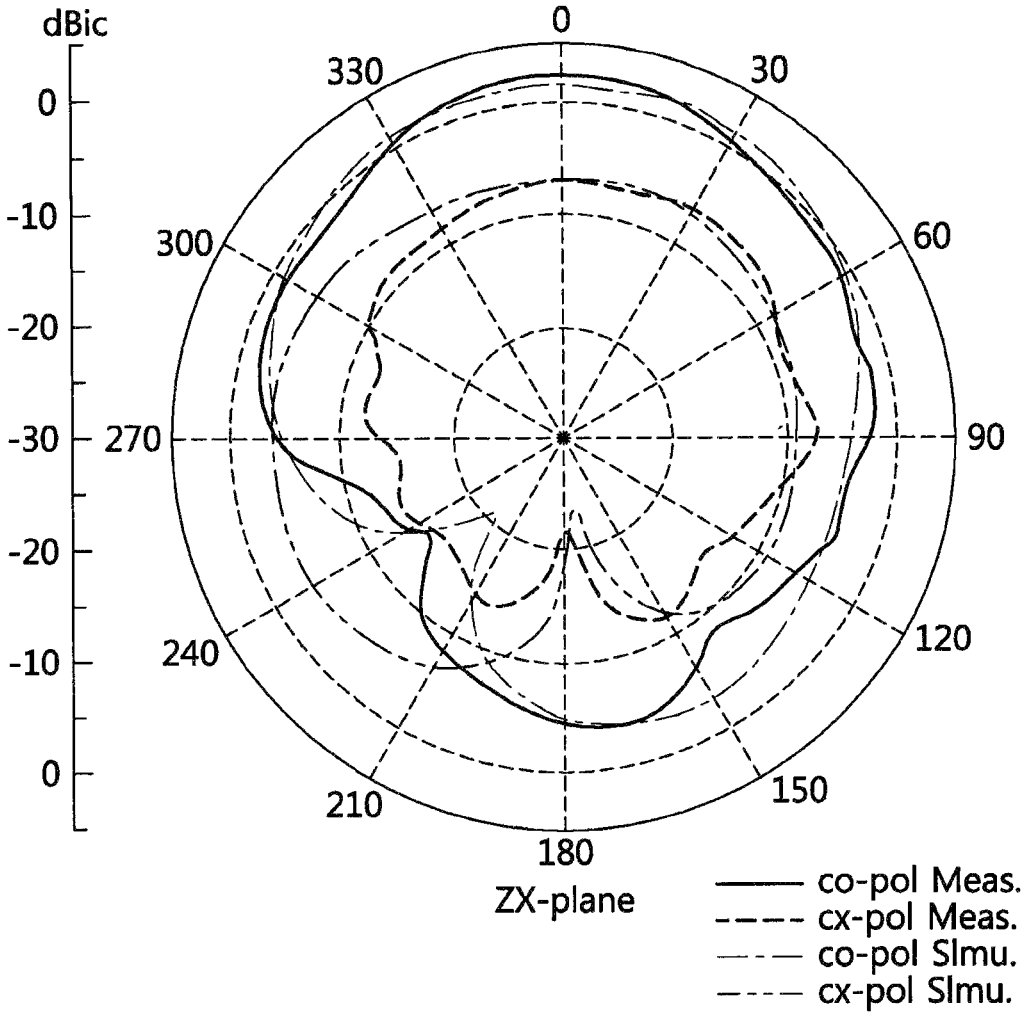
FIG. 8 is a graph illustrating the z-x plane antenna gain of a controlled pattern antenna according to an embodiment of the present invention.

FIG. 8 is a graph illustrating the z-x plane antenna gain of a controlled reception pattern antenna according to an embodiment of the present invention.

As illustrated in FIG. 8, a co-polarization (right handed circular polarization) gain is not biased in the direction (0° to 90°, 270° to 360°) in which GPS satellite signals are received, and is equal to or greater than −5 dBic.

Also, it is confirmed that unwanted cross-polarization (left handed circular polarization) gain is maintained less than the co-polarization gain in the direction in which GPS satellite signals are received.

As described above, optimal embodiments of the present invention have been disclosed in the drawings and the specification. Although specific terms have been used in the present specification, these are merely intended to describe the present invention, and are not intended to limit the meanings thereof or the scope of the present invention described in the accompanying claims. Therefore, those skilled in the art will appreciate that various modifications and other equivalent embodiments are possible from the embodiments. Therefore, the technical scope of the present invention should be defined by the technical spirit of the claims.

What is claimed is:

1. A controlled reception pattern antenna comprising:

a plurality of radiators for receiving a satellite signal;

a ground platform in which the, plurality of radiators are arranged; and a plurality of radiating slots each formed in a shape of narrow opening in the ground platform and each arranged between two adjacent ones of the plurality of radiators and each having a length corresponding to ¼ of a center wavelength of an operating band so as to be operated as a parasitic element of one of the adjacent radiators, wherein when power is fed to one of the plurality of radiators, the radiating slots adjacent to the one of the plurality of radiators are configured to resonate at a frequency corresponding to the center wavelength of the operating band and to operate as parasitic elements of the one of the plurality of radiators so as to increase an antenna gain at a low elevation angle, and wherein the plurality of radiators are formed to be separated from each other in the ground platform, and the plurality of radiating slots are formed to be separated from each other in the ground platform.

2. The controlled reception pattern antenna of claim 1, wherein the radiator is a ceramic patch-type radiator.

3. The controlled reception pattern antenna of claim 1, wherein the ground platform has a circular form.

* * * * *